US006173539B1

(12) United States Patent
Barnes

(10) Patent No.: US 6,173,539 B1
(45) Date of Patent: Jan. 16, 2001

(54) METAL MEMORIAL MONUMENT MARKERS AND METHOD OF MAKING THE SAME

(76) Inventor: James J. Barnes, 1832 Quailwood Dr., Clarkston, WA (US) 99403

( * ) Notice: Under 35 U.S.C. 154(b), the term of this patent shall be extended for 0 days.

(21) Appl. No.: 09/225,840

(22) Filed: Dec. 31, 1998

(51) Int. Cl.[7] ..... E01F 9/011

(52) U.S. Cl. ..... 52/103; 52/104; 52/745.19; 40/124.5

(58) Field of Search ..... 52/103, 104, 745.19; 27/30; 40/124.5

(56) References Cited

U.S. PATENT DOCUMENTS

| | | | | |
|---|---|---|---|---|
| 241,592 | * | 5/1881 | Bausman | 52/103 |
| 498,506 | | 5/1893 | Cameron . | |
| 1,467,391 | * | 9/1923 | McComas | 52/103 X |
| 1,853,772 | * | 4/1932 | McComas | 40/124.5 |
| 1,860,915 | * | 5/1932 | Whitman | 40/124.5 |
| 2,667,000 | * | 1/1954 | O'Connor | 52/103 X |
| 2,917,853 | * | 12/1959 | Lawsky | 40/124.5 X |
| 4,550,537 | | 11/1985 | Smith . | |

FOREIGN PATENT DOCUMENTS

2317313 * 10/1974 (DE) ..... 52/104

* cited by examiner

*Primary Examiner*—Beth A. Stephan
*Assistant Examiner*—Brian E. Glessner
(74) *Attorney, Agent, or Firm*—Ken J. Pedersen; Barbara S. Pedersen

(57) ABSTRACT

The present invention is a metal memorial marker and a method of making the same. The invented marker is made of metal, preferably ⅛" to ½" thick, preferably with steel-chromium alloys, such as stainless steel, or a non-ferrous metals, such as aluminum, brass, bronze, or copper. The present invention is created by taking a plate of the metal and making markings upon one of the surfaces of the plate, said markings denoting a decoration. A computer could be used to guide the cutting equipment by following a preprogrammed template, and as such markings upon one of the surfaces of the plate would not necessarily be necessary. A plasma cutting torch, laser torch or other cutting equipment is then used to make cuts along the markings made on the surface of the plate. Cutting the plate in such a manner results in the creation of openings through the plate, said openings when viewed together forming a decorative pattern. Patterns that can be created using this method include lettering, silhouettes, and decorative artwork in general. The markers themselves can appear to be free standing, can be mounted upon and extend from the top surface of an existing monument, or can be mounted on a surface of an existing monument.

9 Claims, 7 Drawing Sheets

METAL MEMORIAL MONUMENT MARKERS AND METHOD OF MAKING THE SAME

BACKGROUND OF THE INVENTION

1. Field of the Invention

This invention generally relates to the field of monuments. More specifically, the present invention relates to metal monuments serving as, or decorating, a gravestone or memorial.

2. Related Art

Various metal monuments for graves are shown in the prior art. For instance, U.S. Pat. No. 498,506 (Cameron) discloses a cast-metal monument for graves. However, the Cameron patent does not disclose a metal monument having decorative holes cut completely through the metal of the monument.

Another metal monument is described in U.S. Pat. No. 4,550,537 (Smith) which discloses a monument for graves. The Smith patent shows a stainless steel base and head having a front face with a recess for an engraved insert. The Smith patent does not disclose a metal monument having decorative holes cut completely through the metal of the monument.

SUMMARY OF THE INVENTION

The present invention is a metal memorial marker and method of making the same wherein the marker comprises decorative holes in the marker. The marker is made of a metal, preferably non-ferrous (i.e., aluminum, copper, brass, bronze) or a steel-chromium alloy (i.e., stainless steel). A ⅛" to ½" plate of the metal is preferably used. Said thickness can be achieved through the use of multiple plates connected together. The use of a smooth metal or a textured metal, like diamond plate or decking, is also envisioned.

The present invention is created by taking a plate of metal and making markings upon a surface of the plate, said markings denoting a decoration. A plasma cutting torch, laser torch or other cutting equipment is then used to make cuts along the markings drawn on the surface of the plate. Rather than making marks upon the surface of the plate, a computer controlled cutting instrument could be used to follow a pattern from a preprogramed template of a program. Cutting the plate in such a manner results in the creation of openings through the plate, said openings, when viewed together, forming a decorative pattern.

Patterns that can be created using this method include lettering, silhouettes, and decorative artwork in general. For instance, a marker could be created having a silhouette cutout likeness of the person memorialized by the marker.

The markers themselves can appear to be free standing (either through mounting on the surface of the ground, upon a footer, or within the ground), can be mounted upon and extend from the top surface of an existing monument, or can be mounted on a surface of an existing monument.

Other embodiments of the present invention uses spacers or backings for creating a projected effect of the marker mounted on the surface. Another embodiment of the present invention uses solar powered lights lighting the colored backings to illuminate the decorative pattern of the marker at night.

Another embodiment of the present invention has flower pot holders cut or formed into the top or sides of the metal marker. Holders located on the sides can be cut from the side of the marker and bent upwards to a generally horizontal position for the holding of a potted plant, flowers or other item.

Benefits of the present invention include: improving the aesthetics of an existing memorial, durability, resistance to weathering, and a great cost savings in comparison to stone monuments.

DESCRIPTION OF THE PREFERRED EMBODIMENTS

The present invention is metal memorial marker and the method of making the same. The metal memorial marker 100 is to be placed at the grave site or other place where the user wishes to memorialize a person, object, or event, or for decoration in general. The marker 100 can be placed at the site as a gravestone, as an accent to an existing gravestone, as an attachment to an existing gravestone, or as a separate memorial.

The invented marker 100 comprises a plate 50, at least one opening 70 cut through the plate, and preferably an attachment means 20. The invented marker 100 further comprises the object the marker 100 is attached to when that object is a gravestone.

The plate 50 is cut from a sheet of a metal, preferably ⅛" to ½" thick, wherein said thickness may be achieved by a single sheet or by connecting multiple sheets together. The plate 50 is cut to the approximate size of the marker 100 wished to be made. Steel-chromium alloys, such as stainless steel, and non-ferrous metals, such as aluminum, brass, bronze, or copper, are preferred for their durability and greater resistence to weathering and corrosion than ordinary steel or iron. The thickness range of ⅛" to ½" is preferred as the optimum thicknesses considering a balance between strength, durability and weight, however other thicknesses are also envisioned. The manufacturer may also choose to use a textured metal, such as diamond plate or decking, rather than a smooth metal for a particular marker.

Figure 6C:
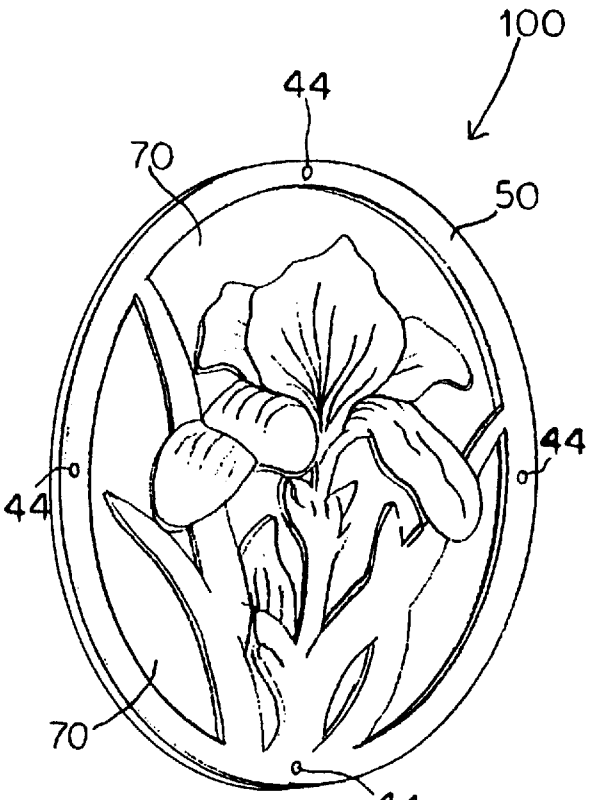
FIG. 6C shows the plate of FIG. 6B after cuts have been made along the markings, thereby creating openings within the plate, this figure also shows texture and detail added to the plate after cutting.
Figure 6B:
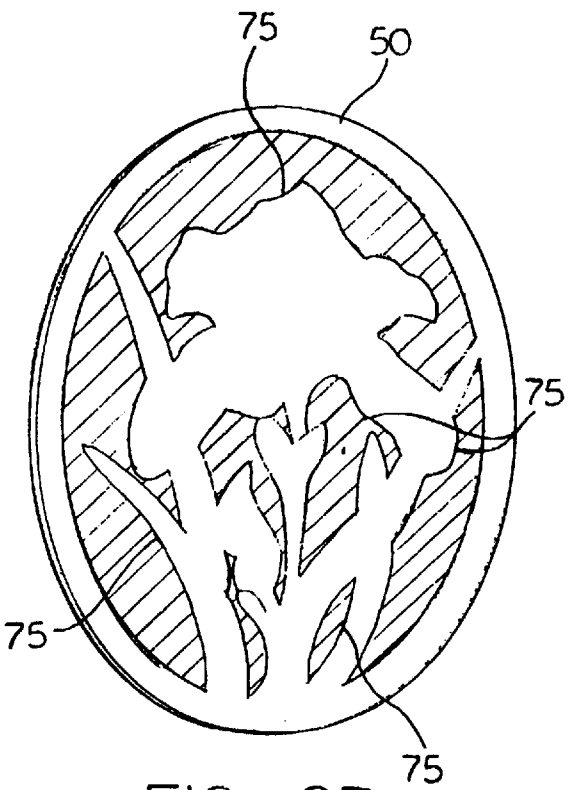
FIG. 6B shows the blank plate of FIG. 6A with markings drawn upon the face of the plate.
Figure 6A:
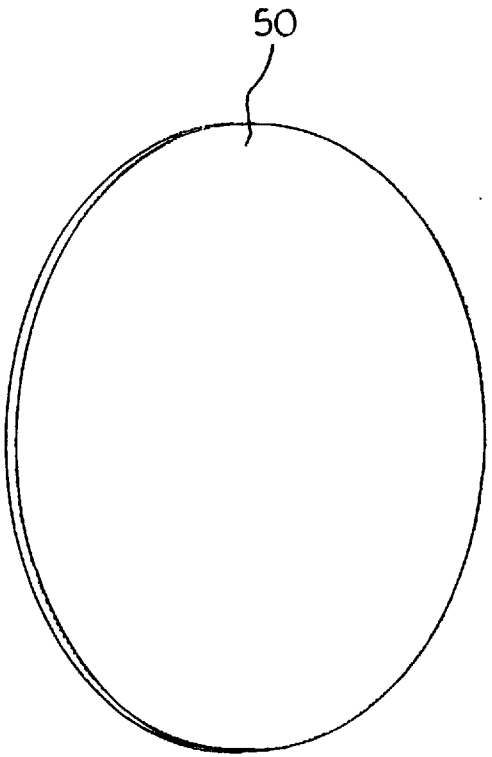
FIG. 6A shows a blank plate of metal.

Preferably, a template (not shown) of the design wished to be used is placed on the blank plate 50, an example of such a blank plate 50 is shown in FIG. 6A. The plate 50 is then marked using common means, such as a metal marker, in the pattern upon the template, thereby creating markings 75, as shown in FIG. 6B. The template is then removed from the plate 50. Alternatively, the user could free-hand markings upon the plate 50 without using a template. A laser torch, plasma cutter, or other cutting device (not shown) is then used to cut the plate 50 along the markings 75. Alternatively, rather than making markings upon the surface of the plate 50, a computer controlled cutting instrument could be used. The computer controlled cutting instrument could be programmed to follow a preprogramed template, thereby cutting along markings programmed into the computer but not actually marked upon the surface of the plate 50. The markings 75 can comprise lettering, numbering, silhouettes, and other decorative patterns. Such cuts are completely through the plate 50, however texture and detail can be added by making additional, thin cuts through the plate 50 or by etching or engraving the surface of the plate 50.

The cuts along the markings 75 result in waste scraps (shown in shaded hatching in FIG. 6B) of metal, which are discarded, and a plate 50 having openings 70 cut in the shape of the pattern of the template, as shown in FIG. 6C. These openings 70 are left open, no screws, bolts, or other attachment means are to be placed in or through these openings 70. That is, nothing is received into the opening 70, thereby allowing an individual to look through the plate 50 and view what is located behind the plate 50, and light is able to travel through the openings 70.

Alternatively, multiple cut sheets could be attached together and when viewed with cut openings, forming a three-dimensional pattern within the marker 100.

Figure 2:
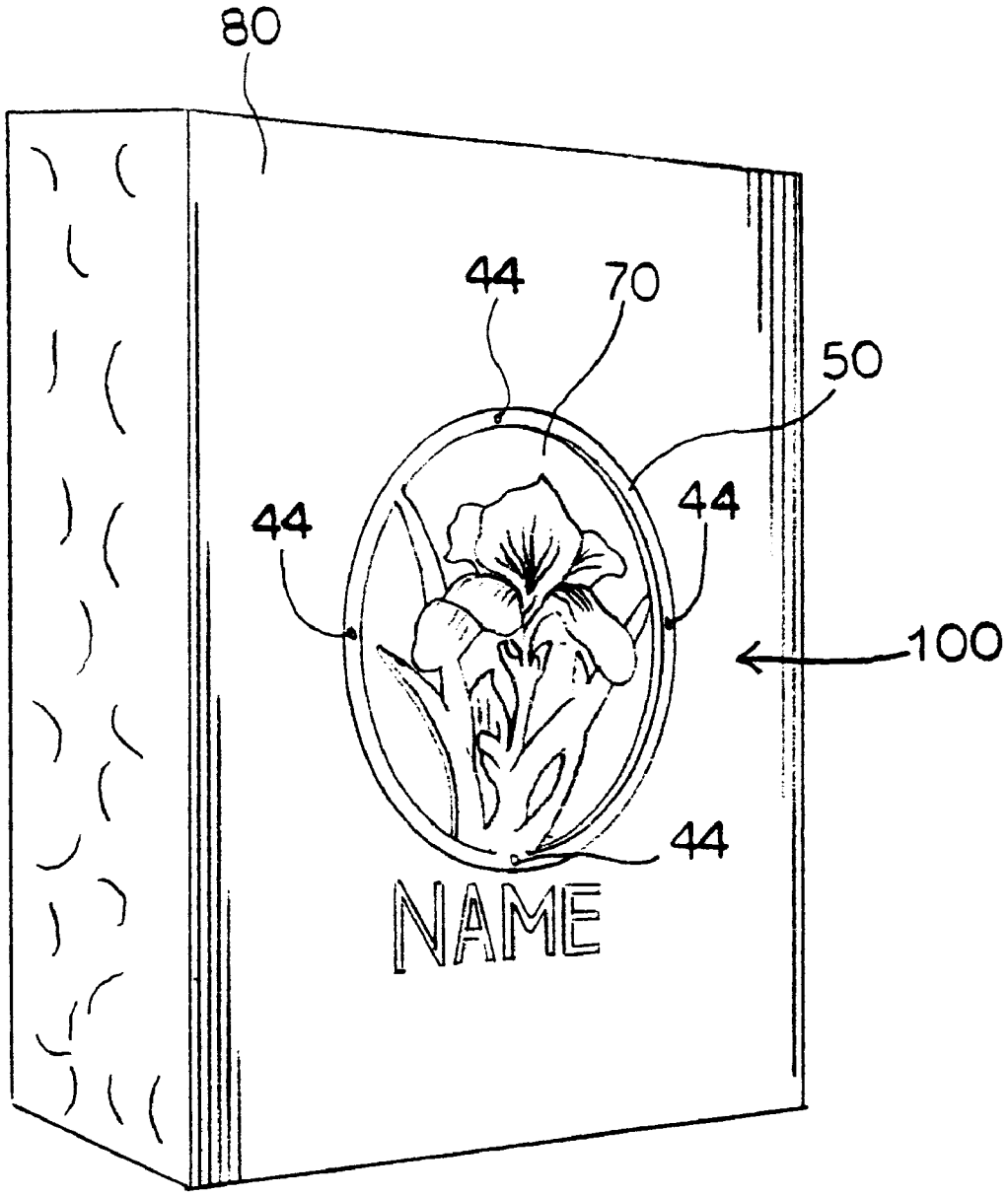
FIG. 2 is a perspective view that shows one embodiment of the present invention that is mounted on the front of a gravestone.
Figure 3A:
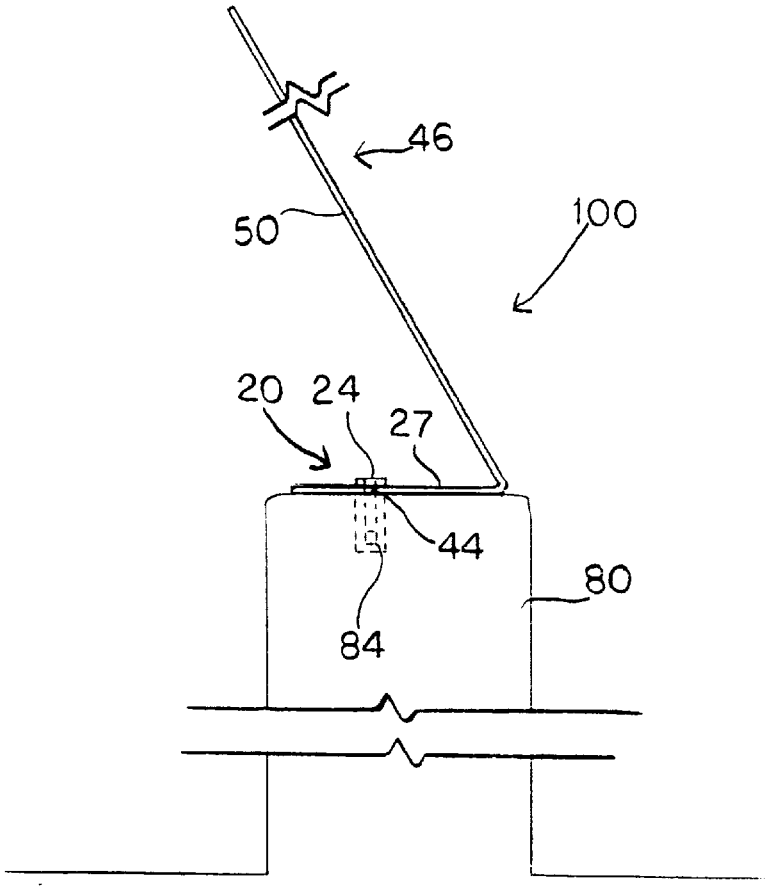
FIG. 3A is a side view of one embodiment of the present invention that mounts on the top of a gravestone.
Figure 3B:
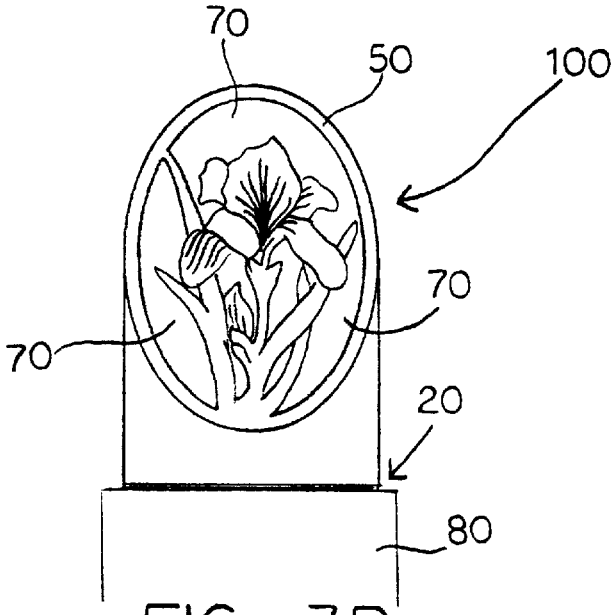
FIG. 3B is a front view of the embodiment shown in FIG. 3A.

The plate 50 is then attached to the ground or an object 80 by an attachment means 20. This object 80 can be any number of things, including: the surface of the ground G (as shown in FIG. 1B), the front of a gravestone (as shown in FIG. 2), the side of a gravestone (not shown), and the top of a gravestone (as shown in FIGS. 3A and 3B). As such, the attachment means 20 will vary depending on the object 80 attached to. The attachment means 20 mentioned infra is not a complete list of all possible attachments, other attachments are envisioned by the inventor.

Figure 1A:
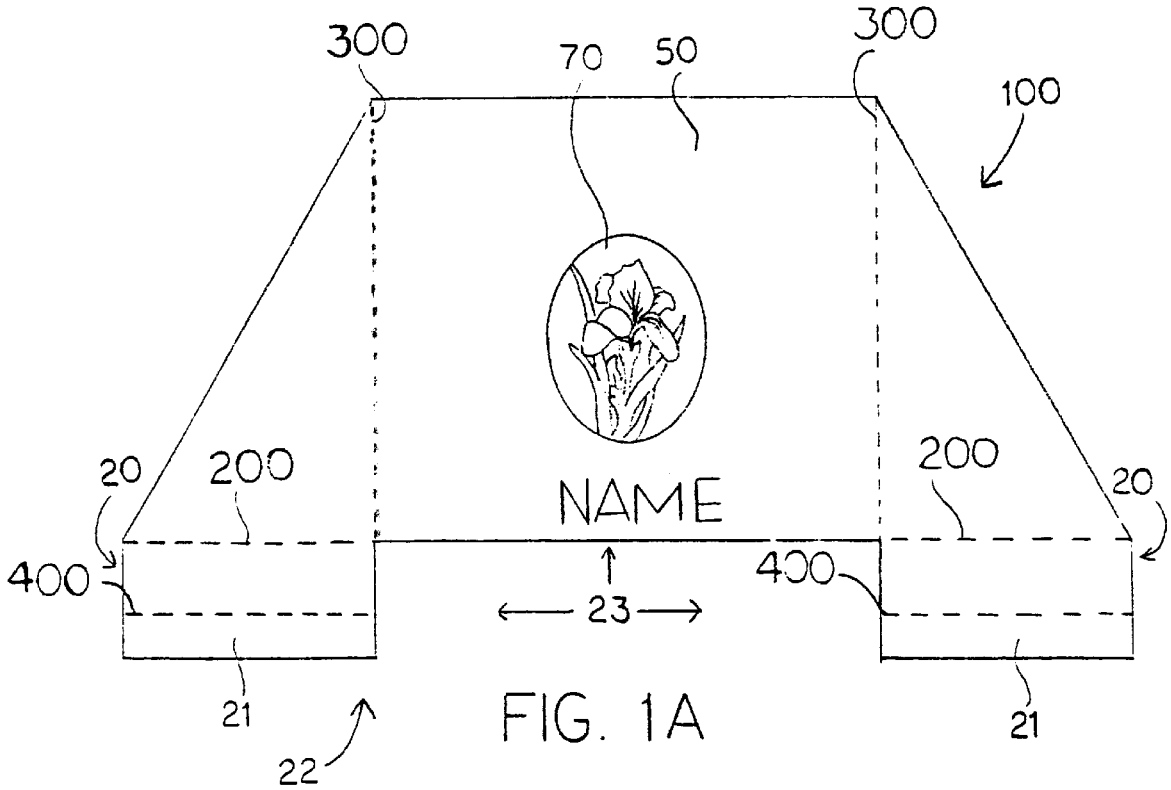
FIG. 1A is a perspective view of one embodiment of the present invention before bending.
Figure 1B:
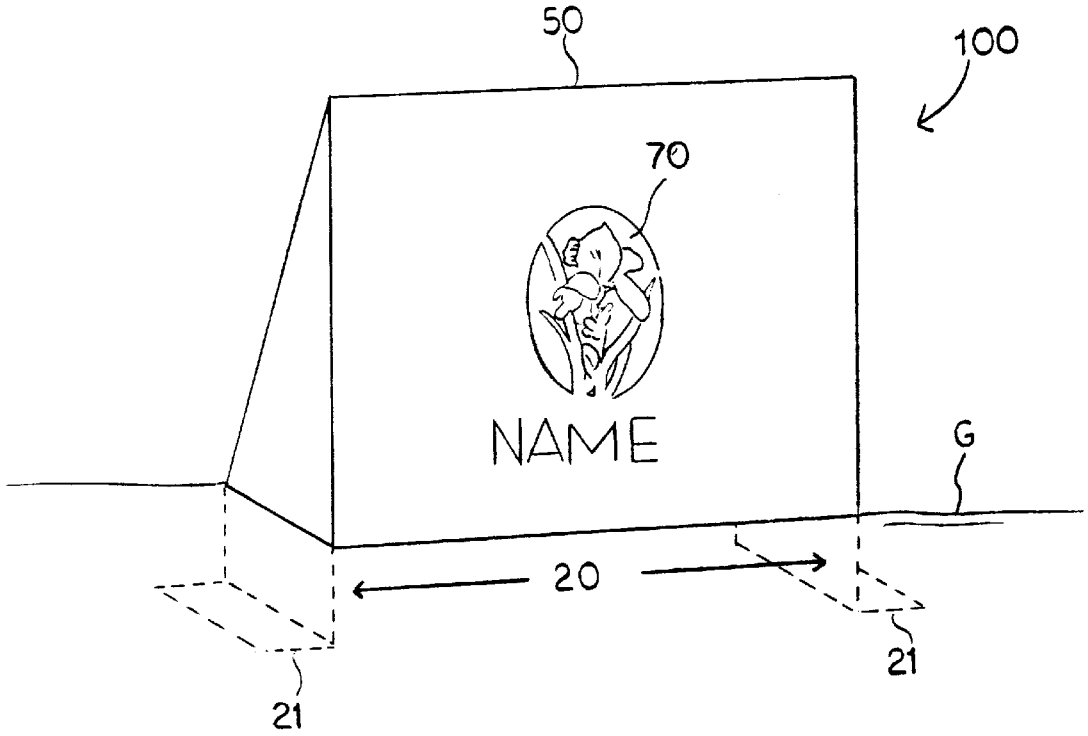
FIG. 1B is a perspective view of the embodiment shown in FIG. 1A, showing the invention after being bent into shape.

A first embodiment of the present invention 100 is shown in FIGS. 1A and 1B. This embodiment comprises a free-standing marker 100 to be attached, using an attachment means, to an object located at or near the surface of the ground, or the surface of the ground itself.

The preferred embodiment uses a generally trapezoidal shaped plate 50. The attachment means 20 on this embodiment comprises at least one flange 21 for insertion into the ground, attachment to an object 80, or for resting upon the surface of the ground. The flange 21 is created on the bottom side 22 of the plate 50 by cutting a notch 23 out of the bottom side 22. The user is free to bend the flange 21 along a first dashed line 200, forming a metal base which would allow the flange to be placed upon and secured to the top surface of the ground, or bend the flange 21 inwards or outwards along a second dashed line 400, forming a lower flange which would allow the flange to be securely buried underground.

The plate 50 is further bent along dashed line 300 toward the rear side of the plate 50, as shown in FIG. 1B, to form an upstanding marker 100. Such bend 300 is preferably at a 90-degree angle, but any angle is possible. The flange or flanges 21 are then to be inserted into the ground, attached to an object such as a buried footer (not shown), or rested upon the ground surface. Various versions of this embodiment can be made, in various shapes, but the key feature of the present invention is openings 70 completely through the marker 100.

Figure 4A:
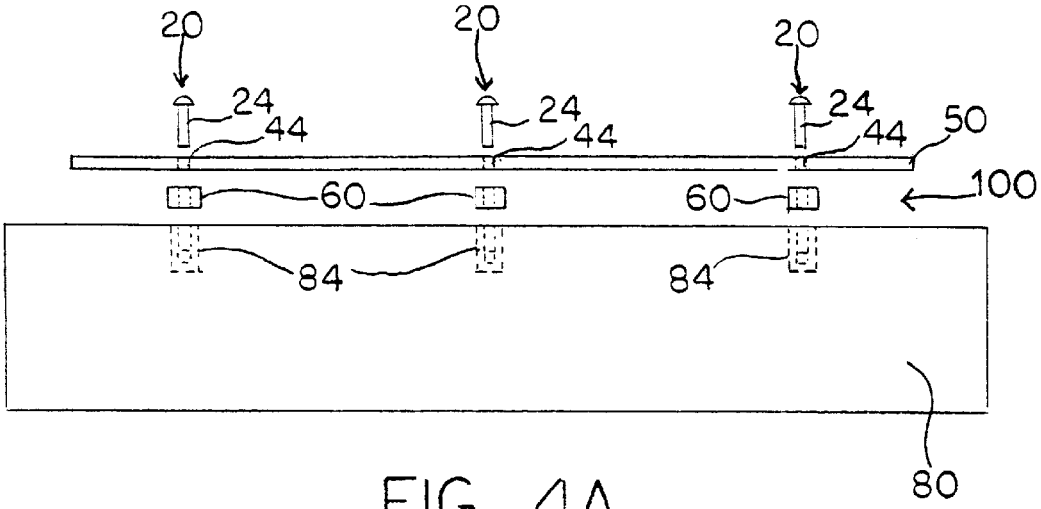
FIG. 4A is an exploded, side view of the embodiment shown in FIG. 2, showing spacers.
Figure 4B:
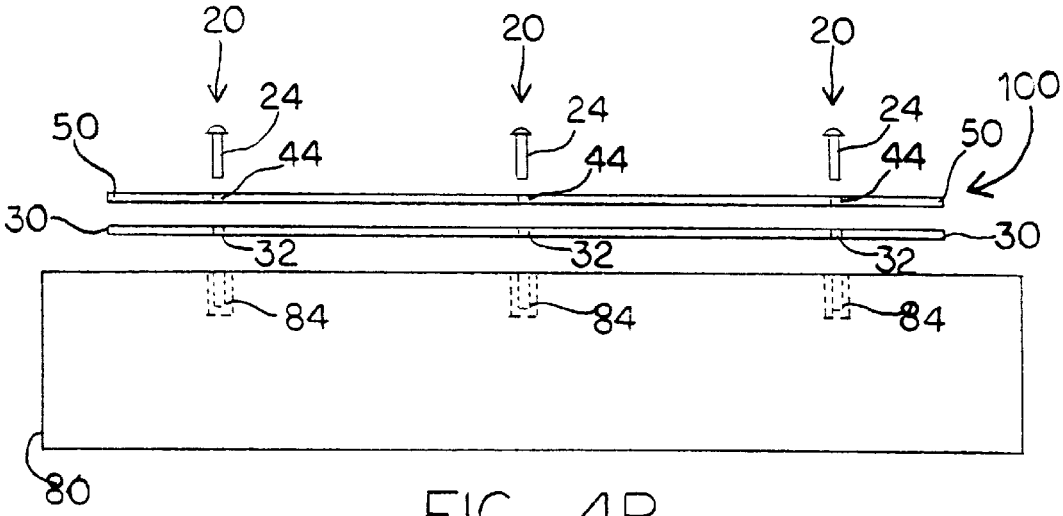
FIG. 4B is an exploded, side view of another version of the embodiment shown in FIG. 2, showing a backing.

A second embodiment of the present invention 100 is shown in FIG. 2. This embodiment comprises a marker 100 attached to the front of an existing object 80, such as the gravestone, shown in FIG. 2, or another object, such as a building (not shown). The preferred embodiment shown in FIG. 2 is created by taking a marker 100 comprising a plate 50 having openings 70 cut through it and fastening this marker 100 onto a surface of the object 80. The preferred methods of attachment 20 are shown in FIG. 4A and FIG. 4B. In general, this method of attachment 20 involves the attachment of the marker 100 to a planar surface of the object 80 through use of an attachment means 20. Such attachment would attach the plate 50 generally parallel to the planar surface of the object 80. While the projection of the marker 100 from the surface of the object 80 is preferred, the marker 100 could be mounted directly upon the surface of the object 80.

One method of projected attachment is the spacer method, an embodiment of which is shown in FIG. 4A. This method of attachment projects the marker 100 away from the surface of the object 80. The spacer method of attachment comprises the placement of a spacer 60 between the marker 100 and the object 80. A spacer 60 is then affixed to the marker 100/object 80 combination in any number of ways.

An embodiment of the spacer method is shown in FIG. 4A. This method first requires the attachment of the marker 100 to the front surface of the object 80 by the drilling of a hole 84 within the object 80 the marker 100 is to be mounted upon, such hole 84 for the receiving a mounting screw 24. After the hole 84 has been drilled the screw 24 is inserted through a hole 44 cut within the marker 100 and then through a spacer 60 for keeping the marker 100 a distance from the front surface of the object 80. This screw 24, inserted through the hole 44 and the spacer 60 is then affixed within the hole 84. The preferred spacer 60 is a hollow bushing for receiving the screw 24, but other forms of spacers 60 are also envisioned by the inventor. The preferred method of attachment uses tamper-proof, stainless steel screws or bolts. The benefits of placing the marker 100 a distance from the front surface of the object 80 is the creation of the visual effect of adding of perspective or a projection effect.

An alternate method of projected attachment is the backing method, an embodiment of which is shown in FIG. 4B. This method of attachment projects the marker 100 away from the surface of the object 80. The backing method comprises the placement of a piece or sheet of backing 30 between the marker 100 and the object 80. The backing 30 is then affixed to the marker 100/object 80 combination in any number of ways.

One embodiment of the backing method is shown in FIG. 4B. This method first requires the attachment of the marker 100 to the front surface of the object 80 by the drilling of a hole 84 within the object 80 the marker 100 is to be mounted upon, such hole 84 for the receiving a mounting screw 24. After the hole 84 has been drilled, the screw 24 is inserted through a hole 44 cut within the marker 100 and then through a hole 32 cut in the backing 30 for keeping the marker 100 a distance from the front surface of the object 80. This screw 24, inserted through the hole 44 and the backing hole 32 is then affixed within the hole 84.

The invented backing 30 is preferably colored for adding color to the viewed marker 100, but other non-colored and even clear backings 30 are also envisioned. The preferred backing 30 is made of plastic, or a metal, preferably copper. Alternatively, the backing 30 could be translucent or clear, allowing an artificial light source (not shown) to light the backing 30 at night. Such a light source could be placed between the object 80 and the backing 30, may be placed in front of or behind the present invention 100, or may be embedded within the backing 30. Preferably this light source would be solar powered.

A third embodiment of the present invention 100 is shown in FIGS. 3A and 3B. This embodiment comprises a marker 100 that is mounted, extending from a surface of an object 80, such as a gravestone, as shown. The marker 100 comprises a plate 50 cut to the shape of the memorial wished to be created. The plate 50 is then marked with a pattern, and openings 70 are cut within the plate 50 as discussed above. This marker 100 is then attached, extending from a surface of an object 80 by an attachment means 20.

Shown in FIGS. 3A and 3B is an attachment means 20 comprising the use of a plate 50 having a bent flange 27 having a hole 44 for receiving a mounting screw 24. This screw 24 is further received into a hole 84 within the object 80. However, other attachment means 20 are also envisioned, so long as the marker 100 can be mounted extending from one of the sides of the object 80. The planar side 46 of the marker 100 may be placed at any angle in relation to the object 80 mounted upon, for instance, the marker 100 could extend generally vertically from the top of the object 80, or could extend at an angle (diagonally) from the top of the object 80. Said marker 100 could also extend generally outward from the side of the object 80.

Also, the completed marker may have added texture and detail, as particularly shown in FIGS. 1A, 2, 3B, and 6C by marking on the iris flower and/or the texture on the non-perforated portions of the marker. This texture may be etched upon the surface of the plate 50 or cut through the plate 50.

Figure 5A:
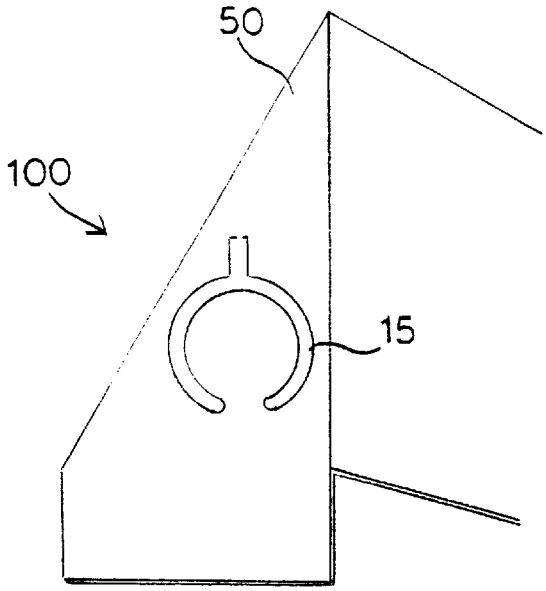
FIG. 5A shows a perspective, side view of one embodiment of the present invention, showing the pot holder cut into the side of the marker, but not bent.
Figure 5B:
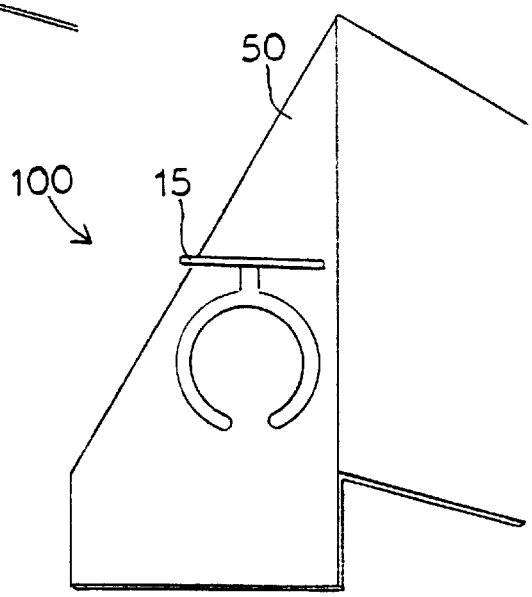
FIG. 5B shows a perspective, side view of the embodiment of the present invention shown in FIG. 5A, showing the pot holder cut into the side of the marker and bent into a generally horizontal position.
Figure 5C:
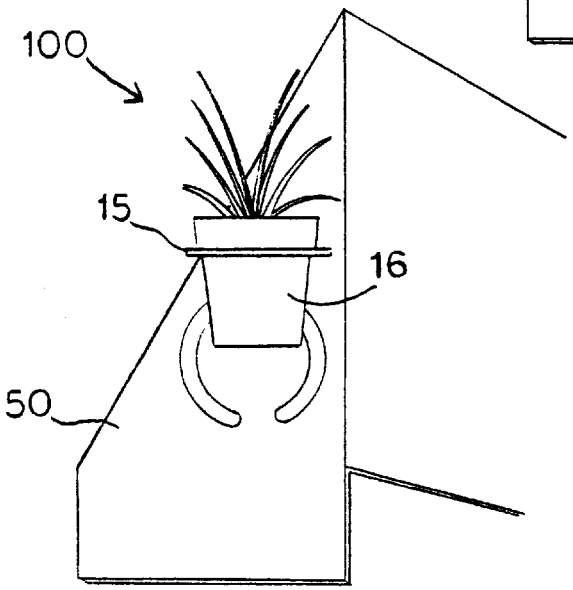
FIG. 5C shows a perspective, side view of the embodiment of the present invention shown in FIG. 5B, showing the pot holder cut into the side of the marker, bent, and holding a flower pot.

The inventor also envisions the creation of plant or flower pot holders extending from the invented marker. One embodiment of these pot holders 15 can be seen in FIGS. 5A–5C. The invented pot holders 15 are preferably cut into the marker 100, as shown in FIG. 5A, and then bent outward to horizontal level, as shown in FIG. 5B. At this horizontal level, a plant pot 16 may be placed within the holder 15, as shown in FIG. 5C. Additionally, the pot holder 15 could extend from or be found upon the top surface of the marker (not shown). Such a pot holder would be mounted horizontally on the top surface of the marker for holding a pot or other container containing a plant, flowers, or other decoration.

Although this invention has been described above with reference to particular means, materials and embodiments, it is to be understood that the invention is not limited to these disclosed particulars, but extends instead to all equivalents within the scope of the following claims.

I claim:

1. A substantially planar metal memorial marker comprising:

a plate of metal having a planar face, said plate having a front and a back;

at least one opening cut through said face of said plate, wherein nothing is received into said opening; and an attachment means located along an edge of said plate for connection of the plate to the ground such that said face is held in a single plane, wherein said plane is adapted to be substantially perpendicular to the ground for use of the plate as a gravestone;

wherein:

said opening allows light to pass through said face at substantially any angle to produce a visually perceptible pattern wherein said pattern may be perceived from a viewing position in front of or in back of said plate; and said opening allows a viewer to look through said plate to view what is located in front of or in back of said plate.

2. A metal memorial marker, as in claim 1, wherein:

said plate has a flange; and said attachment means is through insertion of said flange into the ground.

3. A metal memorial marker, as in claim 1, wherein:

said plate has a flange; and said attachment means is through attachment of said flange to a footing buried in the ground.

4. A metal memorial marker, as in claim 1, wherein said attachment means is done by resting said plate upon the ground.

5. A metal memorial marker, as in claim 1, wherein said plate has a plant pot holder extending therefrom.

6. A method of making a substantially planar metal memorial marker comprising the steps of:

taking a plate of metal having a planar face;

marking said face of said plate with marks denoting a pattern;

cutting through said plate along said marks to form openings in the shape of said pattern, wherein nothing is received into said openings; wherein said openings allow light to pass through said face at substantially any angle to produce a visually perceptible pattern wherein said pattern may be perceived from a viewing position in front of or in back of said plate, and said openings allow a viewer to look through said plate to view what is located in front of or in back of said plate, forming an attachment means for connecting the plate to the ground such that said face is adapted to be held in a single plane, substantially perpendicular to the ground; and using said plate as a gravestone.

7. A method of making a substantially planar metal memorial marker, as in claim 6, wherein:

said plate has a flange; and said attachment means is through insertion of said flange into the ground.

8. A method of making a substantially planar metal memorial marker, as in claim 6, wherein:

said plate has a flange; and said attachment means is through attachment of said flange to a footing buried in the ground.

9. A method of making a substantially planar metal memorial marker, as in claim 6, wherein:

said attachment means is done by resting said plate upon the ground.

* * * * *